United States Patent [19]

Takenoya et al.

[11] 4,289,087

[45] Sep. 15, 1981

[54] SEWING MACHINE WITH THREAD-TENSION CONTROL SYSTEM

[75] Inventors: Hideaki Takenoya; Kazuo Watanabe; Tamotsu Nakagawa; Yoshinobu Tonomura, all of Hachioji, Japan

[73] Assignee: Janome Sewing Machine Co., Ltd., Tokyo, Japan

[21] Appl. No.: 80,070

[22] Filed: Sep. 28, 1979

Related U.S. Application Data

[63] Continuation-in-part of Ser. No. 907,294, Mar. 6, 1978, abandoned.

[51] Int. Cl.[3] ..... D05B 47/04

[52] U.S. Cl. ..... 112/254; 112/158 E

[58] Field of Search ..... 112/254, 255, 158 E, 112/121.12, 79 R; 242/150 M, 150 R; 66/210, 211, 146

[56] References Cited

U.S. PATENT DOCUMENTS

| | | | |
|---|---|---|---|
| 3,221,519 | 12/1965 | Bassist | 66/211 |
| 3,797,426 | 3/1974 | Von Hagen | 112/254 |
| 3,991,954 | 11/1976 | Schwartz | 242/150 M |
| 4,166,423 | 9/1979 | Brienza et al. | 112/254 |

FOREIGN PATENT DOCUMENTS

| | | | |
|---|---|---|---|
| 45-18060 | 6/1970 | Japan | 242/150 M |

*Primary Examiner*—Peter P. Nerbun
*Attorney, Agent, or Firm*—Michael J. Striker

[57] ABSTRACT

The tension of the sewing machine's upper thread is varied automatically, in a variety of ways not requiring conscious participation on the part of the user of the machine. When one of a set of selectable stitch-patterns is selected by the user, an appropriate thread-tension value is automatically established, although the user retains the ability to adjust the automatically established tension value if he wishes. When the user swings the presser-foot lever of the machine up, to raise the cloth presser foot up from the cloth, e.g., for basting work, the thread tension is automatically lowered to a predetermined value suitable for basting, although still adjustable by the user if he thinks necessary. Where a stitch-pattern is implemented using an addressable ROM, tension command data for each stitch of the stitch-pattern may be stored in the ROM, for variation of thread tension from constituent stitch of the pattern to the next. Alternatively, the ROM stores no tension control data per se, and instead a calculating circuit calculates, from the mere stitch-control data presented by the ROM, distance-dependent values dependent upon the distances between successive needle-penetration locations of the stitch-pattern, and from those derives appropriate tension command signals.

20 Claims, 8 Drawing Figures

SEWING MACHINE WITH THREAD-TENSION CONTROL SYSTEM

CROSS-REFERENCE TO RELATED APPLICATION

The present application is a continuation-in-part of copending application Ser. No. 907,294 filed Mar. 6, 1978, now abandoned.

BACKGROUND OF THE INVENTION

The present invention concerns the problem of correctly tensioning the thread used in a sewing machine.

Very often in sewing machines, when the user swings up the presser-foot lever of the machine, to raise the cloth presser foot from cloth-engaging to inoperative position, the machine's thread-tension disks are relieved, to terminate tensioning action. This is done so that thread can be freely drawn from the thread spool in the course of manually repositioning the workpiece for continued sewing, or as an incident to removal of the workpiece from the machine. In some machines, there is a complete loss of thread tension when the cloth presser foot is raised to inoperative position. However, this can be very disadvantageous for the case where basting work is done with the pressure foot kept raised, because a situation of insufficient thread tension can readily occur. In some machines, of the type where the thread-tensioning action is terminated upon raising of the presser foot, the mechanism employed is such that the thread-tensioning action happens to be progressively decreased in the course of raising the presser foot to inoperative position. A disadvantage with mechanisms of that type is that, when sewing a very thick workpiece, e.g., consisting of several layers of thick cloth, the presser foot may be kept elevated from its lowermost position by the thick workpiece itself, resulting in an incidental and inappropriate thread-tension decrease. Some sewing machines maintain non-zero upper thread tension, even when the cloth presser foot is raised to inoperative position, and this is potentially useful for basting work performed with the presser foot elevated. However, beyond the mere fact of non-zero upper thread tension in such a situation, it would really be necessary to be able to finely adjust the thread tension value, dependent upon the particular basting job involved, but this has been very difficult to provide and in general when the cloth presser foot is in raised, inoperative position, no fine-adjustment capability remains for thread-tension control.

Problems of appropriate thread-tension action can be particularly troublesome in the case of sewing machines having stitch-pattern capabilities, e.g., machines able to implement stitch-patterns of intricate configuration by resort to the now familiar pattern-ROM technique. In such patterns, the needle bar of the machine may be transversely displaced proceeding from one constituent needle-penetration location of a stitch-pattern to the next by transverse distances varying greatly from one constituent stitch of the pattern to the next, and likewise the amount and the direction of the cloth feed increment may vary from one needle-penetration action to the next with a considerable frequency and range of variation within the course of a single stitch-pattern. Furthermore, some stitch-patterns may be constituted by intervals of intricate stitch configuration alternating with intervals of simple straight stitching, further adding to the complexity of the tension-control aspect of pattern implementation. In general, the user of the machine is able to manually adjust thread tension, e.g., prior to commencement of automatic sewing of a particular stitch-pattern, but it is not in general feasible to manually adjust thread tension during the course of implementation of the successive stitches of such a stitch-pattern.

In addition to the tension-control implications of an intricate stitch-pattern geometry, the user must, of course, furthermore take into account factors of workpiece thickness and the thickness and character of the thread employed, e.g., slick thread or rough thread in the case of disk-type tensioning mechanisms which establish thread tension by mere frictional drag on the thread. These various factors can make it far from self-evident to the operator how the thread tension should be set for a particular job.

SUMMARY OF THE INVENTION

It is a general object of the invention to provide sewing-machine tension-control systems which overcome the disadvantages and limitations of the prior art.

In accordance with various features of the present invention, use is made of an electromechanical thread-tension varying mechanism which varies thread tension in dependence upon an electrical thread-tension command signal, with the value of the thread-tension command signal being automatically selected and/or automatically varied in a variety of situations without the need for the user to consciously participate in this automatic action. Advantageously, however, the user is provided with means for manually modifying the thread-tension command signal, in situations where the user deems it appropriate to deviate from the automatically selected tension values.

In one embodiment of the invention, when the user manually selects a stitch-pattern from a plurality of available stitch-patterns, the tension-control system automatically responds by selecting a thread-tension value appropriate for the selected stitch-pattern. An auxiliary, manually operated selector, which may for example normally be kept in a particular setting, is provided for use in those instances where the user feels it necessary to deviate from the automatically selected and pattern-dependent tension value. When the user raises the machine's cloth presser foot, e.g., in order to do basting work with the presser foot kept in raised position, the tension-control system responds by automatically selecting a low but non-zero tension value, which the user can finely adjust, if necessary, preferably by means of the same auxiliary selector just mentioned.

In another embodiment of the invention, a pattern memory stores, in its addressable storage locations, not only stitch-control data used to command the successive stitches of a stitch-pattern, but in addition thereto actual tension-control data for each successive stitch of such stitch-pattern, and the tension command signal is derived from the tension-control data, so that the thread tension for each stitch of the pattern be appropriately and automatically selected, with the user, however, retaining the ability to apply a manually selected corrective factor to this sequence of automatically generated thread-tension command signals, e.g., for extremes of cloth thickness, and the like.

In a further embodiment, the pattern memory is not called on to store tension-control data per se, and thereby need not have an increased bit capacity for such additional data. Instead, computational circuitry derives from the mere stitch-control data presented by the memory distance-dependent values dependent upon the physical distances between one constituent needle-penetration location of a stitch-pattern and the next, again with the user having the ability to apply a corrective factor for extremes of cloth thickness, and the like.

In another embodiment, in order that the user be as seldom as possible called on to apply such corrective factors, the tension command signal is derived from a nominally-required-tension signal, which does not take into account factors such as workpiece thickness and thread thickness and character, but which is then automatically compensated in dependence upon signals which indicate workpiece thickness and thread thickness and character. The user is still provided with the ability to apply a corrective factor to the automatically generated tension command signals, but need do so only when the automatic compensation for workpiece thickness and thread character fails, for whatever reason, to produce a convincing and satisfactory end product.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
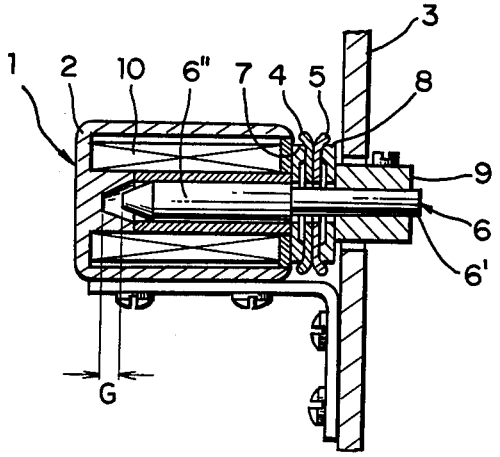
FIG. 1 depicts a first electromechanical tension-varying device.
Figure 2:
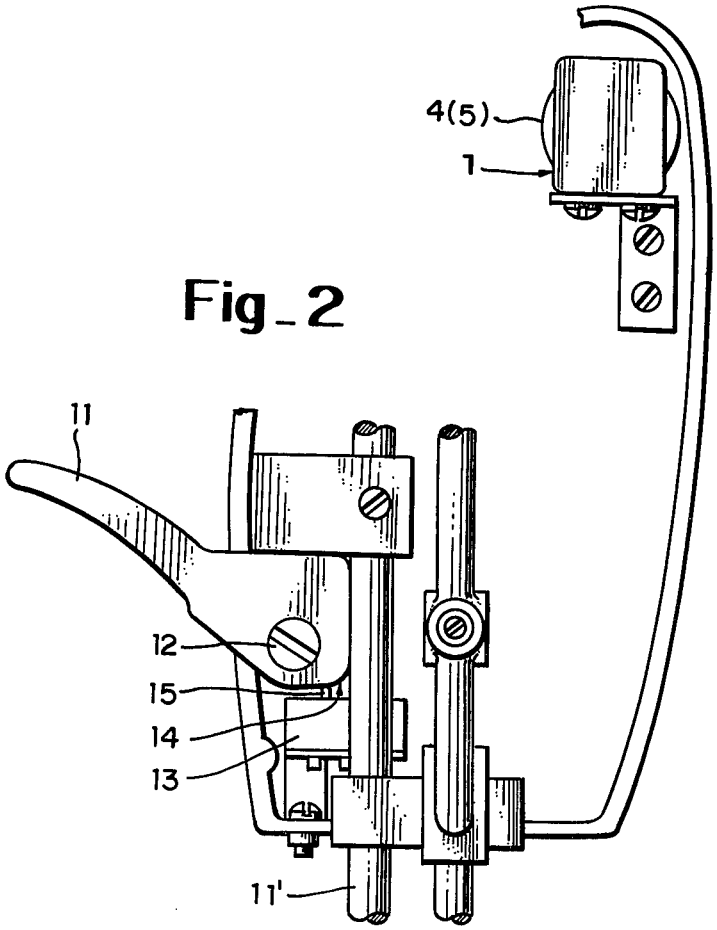
FIG. 2 depicts the device of FIG. 1 in end view, and also certain other components of a sewing machine.

FIGS. 1 and 2 depict an exemplary version of the electromechanical part of a thread-tension control system embodying the present invention.

In FIG. 1, numeral 1 denotes a plunger-type solenoid whose stator 2 is bracket-mounted on a wall 3 of the housing of a sewing machine. Numerals 4 and 5 denote two cooperating thread-tension disks between which the sewing thread is guided and pressed for thread-tension control. The two thread-tension disks 4, 5 have central apertures through which freely passes the armature 6 of the plunger-type solenoid 1. Armature 6 has a smaller-diameter right part 6' and a larger-diameter left part 6''. The two tension-control disks are axially confined intermediate two bearing plates 7, 8 likewise encircling the smaller-diameter part 6' of armature 6. A stop member 9 is screwed to the end of part 6' of armature 6, so that when armature 6 is pulled leftward stop member 9 press the disks 4, 5 and the bearing plates 7, 8 together. When the coil 10 of solenoid 1 is energized more strongly, armature 6 is more strongly pulled leftward; when the energization of coil 10 is lowered, armature 6 is less strongly pulled leftward, resulting in a corresponding relaxation of the force with which the tension-control disks 4, 5 are pressed against each other, and thereby resulting in a correspondingly lowered thread tension. The degree of thread tension resulting from a certain value of energizing current for solenoid winding 10 can be adjusted by releasing the adjusting screw of stop member 9 and resetting the position of member 9 on armature 6. G denotes the gap between leftmost position of armature 6 and the position which it is constrained to occupy in an exemplary instance of tension-control action.

FIG. 2 depicts further mechanical components involved in thread-tension control, shown mounted on a sewing-machine housing depicted in end view. Numeral 11 denotes the user-operated presser-foot lever of a sewing machine. Presser-foot 11 pivots about a pivot screw 12, and is swung by the user to its upper illustrated setting when the machine's (non-illustrated) cloth presser foot is to be raised out of pressing engagement with the cloth being sewn; lever 11 is swung down by the user when the cloth presser foot is to be lowered into pressing engagement against the sewn cloth. Numeral 13 denotes a single-pole, double-throw microswitch having an actuator button 15. The end 14 of presser-foot lever 11 acts as a cam, depressing actuator button 15, and thereby causing microswitch 13 to assume one of its two states, when lever 11 is in its illustrated raised position, end 14 of lever 11 permitting button 15 to release when the presser-foot lever 11 is swung down to operative position, thereby causing microswitch 13 to assume the other of its two states. Numeral 11' denotes the presser-foot rod controlled by lever 11, and at the bottom end of which the conventional (non-illustrated) cloth presser foot is articulately mounted in the usual way. Also shown in FIG. 2 is the location on the machine housing of the tension-control mechanism of FIG. 1.

Figure 3:
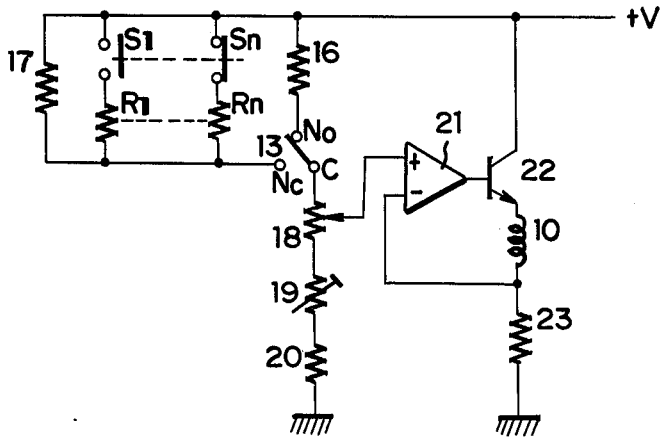
FIG. 3 depicts an exemplary embodiment of a control circuit for the tension-varying device of FIG. 1.

FIG. 3 depicts an exemplary embodiment of a control circuit which can be used to control the energization of the winding 10 of the solenoid 1 of FIG. 1. As shown in FIG. 3, the microswitch 13 includes a movable contact C, whose setting is determined by the setting of actuator button 15 of FIG. 2, and two stationary contacts $N_O$ and $N_C$ alternatively engaged by contact C.

When presser-foot lever 11 is raised to inoperative position, e.g., for basting work, contact C engages contact $N_O$, connecting a resistor 16 in series with a potentiometer 18, an adjustable resistor 19 and a fixed resistor 20, forming a voltage divider connected between operating voltage +V and ground.

When presser-foot lever 11 is swung down to operative position, for normal sewing, contact C engages contact $N_O$, thereby disconnecting resistor 15 from resistor elements 18–20, and instead connecting to the latter the parallel connection of a resistor 17 and one of a set of resistors $R_1, \ldots, R_n$. Each of resistors $R_1, \ldots, R_n$ is connected in series with a respective normally open pattern-selector switch $S_1, \ldots, S_n$. The sewing machine is of the type provided with a (non-illustrated) patterning mechanism affording the user a plurality of selectable stitch-patterns, selectable, e.g., by means of a row of pushbuttons provided on the exterior of the machine housing, the patterning mechanism being either of the electrical, the electronic or the cam-controlled type, each of these types of patterning systems being conventional and familiar to persons skilled in the art. When, for example, the n-th of the available stitch-patterns is selected by the user, this locks switch $S_n$ in the illustrated closed setting thereof, thereby connecting resistor $R_n$ in parallel with resistor 17.

The wiper of potentiometer 18 is connected to the non-inverting input of an operational amplifier 21 whose output is connected to the base of a transistor 22. The collector-emitter path of transistor 22 is connected, in series with solenoid winding 10 and a fixed resistor 23, between operating voltage +V and ground. The junction between solenoid winding 10 and resistor 23 is connected to the inverting input of operational amplifier 21, for negative-feedback purposes, to form a constant-current source whose output current is determined by the voltage applied by the wiper of potentiometer 18 to the non-inverting input of amplifier 21.

Resistor 19 is a factory- or service-adjusted resistor, for adjustment of the range of values of current driven through solenoid winding 10. Potentiometer 18 is adjusted by the user of the sewing machine, e.g., for the purpose of adjusting an automatically selected value of thread tension when particularly thin and fragile or particularly heavy and tough cloth is involved; the wiper of potentiometer 18 may, for example, have a middle setting in which it is normally maintained by the user, except when the user thinks it appropriate to depart from an automatically selected thread-tension value.

When presser-foot lever 11 is elevated, e.g., for basting, and accordingly contact C engages contact No, the energizing current for solenoid 10, and accordingly the thread-tension value, is established in dependence upon the resistance of resistor 16. If the presser-foot lever 11 is swung down to operative position, contact C engages contact $N_C$, and the energizing current of solenoid 10 assumes a value depending upon which one of pattern-selector switches S1, . . . , $S_n$ is closed. The resistance values of resistors $R_1, \ldots, R_n$ differ from one another, and each is so dimensioned as to result in a thread-tension value appropirate for the stitch-pattern selected by the respective selector switch $S_1, \ldots, S_n$. The resistance value of resistor 16 is higher than that of the parallel combination of resistor 17 and any single one of the pattern-dependent resistors $R_1, \ldots, R_n$, as a result of which the thread-tension value associated with the raised, inoperative position of presser-foot lever 11 will be the lowest one of the automatically selected thread-tension values. When the presser foot of the machine is raised at the end of an interval of sewing, it is thereby achieved that a predetermined non-zero value of thread-tension is automatically maintained, to prevent tangling of the thread, and the like. Likewise, if presser-foot lever 11 is kept in raised, inoperative position during basting work, a non-zero value of thread tension is automatically maintained. Furthermore, the automatically selected thread-tension value is adjustable by means of user-operated potentiometer 18, so that exactly the right tension value for a particular instance of basting work can be easily set.

Figure 5:
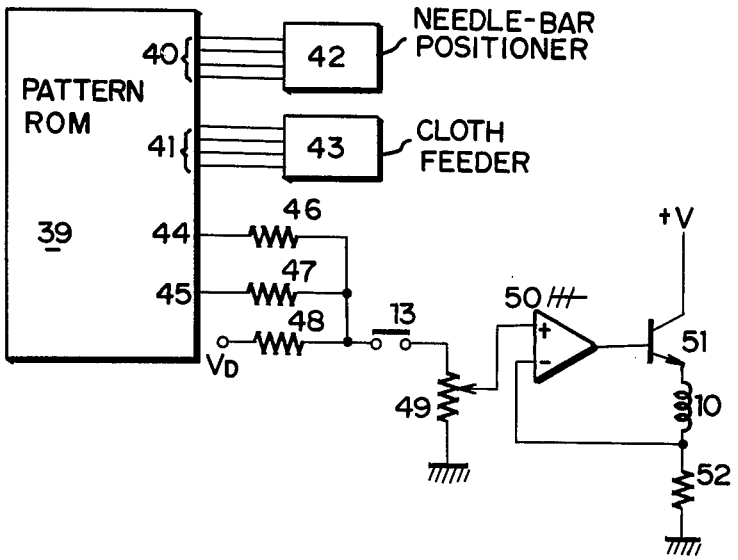
FIG. 5 depicts a second exemplary embodiment of a control circuit for the device of FIG. 1.

FIG. 5 depicts another control circuit for controlling the energization of solenoid winding 10 of FIG. 1. Numeral 39 denotes a conventional pattern ROM storing the stitch-control data for successive stitches of one or more stitch-patterns in individually addressable internal storage locations. Each storage location has a 12-bit capacity, and when any one such storage location is addressed, the first five bits stored therein appear at the five outputs 40 of ROM 30, the second five bits stored therein at outputs 41, and the last two bits at ROM outputs 44 and 45. In conventional manner, the five bits at outputs 40 are used as a needle-bar position command, and successive 5-bit commands are applied to the machine's needle-bar positioner unit 42; the five bits at outputs 41 constitute a cloth-feed command, and successive cloth-feed command are applied to the machine's cloth feeder unit 43. The two additional bits contained in each addressable storage location, and appearing at outputs 44, 45 when a storage location is addressed, serve as tension-control data. The binary signals produced at ROM outputs 44, 45 are applied to the left terminals of respective resistors 46 and 47 (if necessary, via appropriate interface stages, such as amplifiers). The right terminals of resistors 46 and 47 are connected in common with the right terminal of a resistor 48, to whose left terminal is applied a voltage $V_D$. The resistance values of resistors 46, 47, 48 and the voltage $V_d$ are so dimensioned that the four possible combinations of two bits produced at ROM outputs 44, 45 result in the establishment of four differing voltages at the right terminals of resistors 46, 47, 48.

Numeral 13' denotes a microswitch, activated in the manner of microswitch 13 of FIG. 2. When the presser-foot lever is raised to inoperative position microswitch 13' is open as shown; when the presser-foot lever is lowered to operative position microswitch 13' closes and applies the voltage at the right terminals of resistors 46, 47, 48 to the upper terminal of a user-operated potentiometer 49. The wiper of potentiometer 49 is connected to the non-inverting input of an operational amplifier 50, whose input is connected to the base of a transistor 15, the collector-emitter path of which is connected in series with solenoid winding 10 and a fixed resistor 52 between operating voltage +V and ground. The junction between solenoid winding 10 and resistor 52 is connected to the inverting input of operational amplifier 50, so that amplifier 50 together with transistor 51 act as a constant-current source having a solenoid winding 10 as its load. Potentiometer 49 may, for example, have a specially marked normal setting, in which it is left by the user when no departure from automatically selected thread-tension values is required, with the user moving the wiper of potentiometer 49 out of normal setting when, for example, extremes of cloth thickness or thinness or grades of thread are involved.

During the implementation of a stitch-pattern, successive storage locations of pattern ROM 39 are read out, the twelve bits of control data in each such storage location appearing at outputs 40, 41 and 44, 45 of the ROM. For each successive stitch of the stitch-pattern, a respective 2-bit thread-tension control signal is produced at outputs 44, 45, resulting in the establishment of a respective one of four differing levels of energization of solenoid winding 10. Accordingly, the thread tension can, if necessary, be changed from one stitch of the stitch-pattern to the next.

Figure 4:
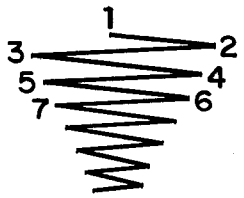
FIG. 4 depicts an exemplary stitch-pattern, referred to in explanation of certain problems of thread-tension control.

The ability to automatically vary the thread-tension value from one stitch of a stitch-pattern to the next can be of considerable benefit for certain types of stitch-patterns. For example, in the arrowhead pattern depicted in FIG. 4, where the successive needle penetrations of the pattern are denoted by consecutive numbers, it will be evident that a relatively lower thread-tension value is appropriate for the initial stitches of the pattern, and a relatively higher tension value for the last stitches of the pattern.

Figure 7:
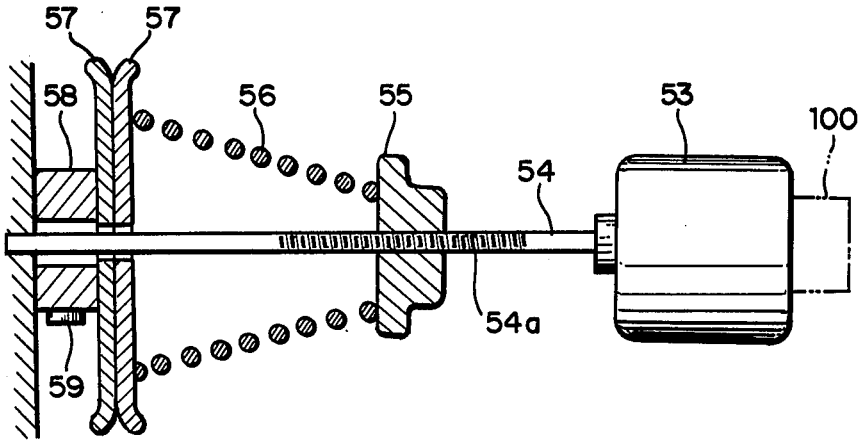
FIG. 7 depicts a second electromechanical tension-varying device.

In FIG. 7, for the sake of simplicity, a 2-bit tension-control signal is produced by ROM 39. However, it will be understood that, if more than four automatically selected tension values are to be afforded, it would merely be necessary to use a greater number of bits for the tension-control code word employed. Likewise, the particular interconnection of resistors 46, 47, 48 is merely explanatory, and other configurations will be evident. For example, in FIG. 3 each of the switches $S_1$, . . . , $S_n$ could be an electronic switch whose control electrode is controlled by a respective one of the bits of the tension-control code word produced by the pattern ROM.

In FIG. 5, by way of example, when the presser-foot lever is swung up to inoperative position, microswitch 13' simply opens, with the result that the thread tension drops to zero, for example to whatever low value might be afforded by a biasing spring bearing against the tension-control disks employed. Alternatively, however, the microswitch 13' of FIG. 5 could be provided as a double-throw switch like 13 in FIG. 3 cooperating with a fixed resistor like resistor 16 of FIG. 3, so that the tension value established when the presser foot is in raised, inoperative position be, here likewise, electrically established and then also adjustable by means of the user-operated potentiometer.

In the control circuits of FIGS. 3 and 5, and the other exemplary ones disclosed herein, it can also be advantageous to automatically interrelate the thread-tension value with a manually selected cloth-feed increment for ordinary straight stitching. For example, when one of the selectable stitch-patterns is not to be used, but instead the machine is to form mere straight stitching, the input of amplifier 21 of FIG. 3 or 50 of FIG. 5 could be disconnected, by suitable switching action, from the illustrated circuitry and instead connected to the wiper of another potentiometer, the wiper being mechanically coupled to the clotch-feed-increment selector dial of the machine. In that way, when the user manually selects a longer cloth-feed increment for simple straight stitching, this would automatically serve to reduce the thread-tension value established; and when the user manually selects a shorter cloth-feed increment for straight stitching, this would serve to automatically raise the thread-tension value employed.

Figure 6:
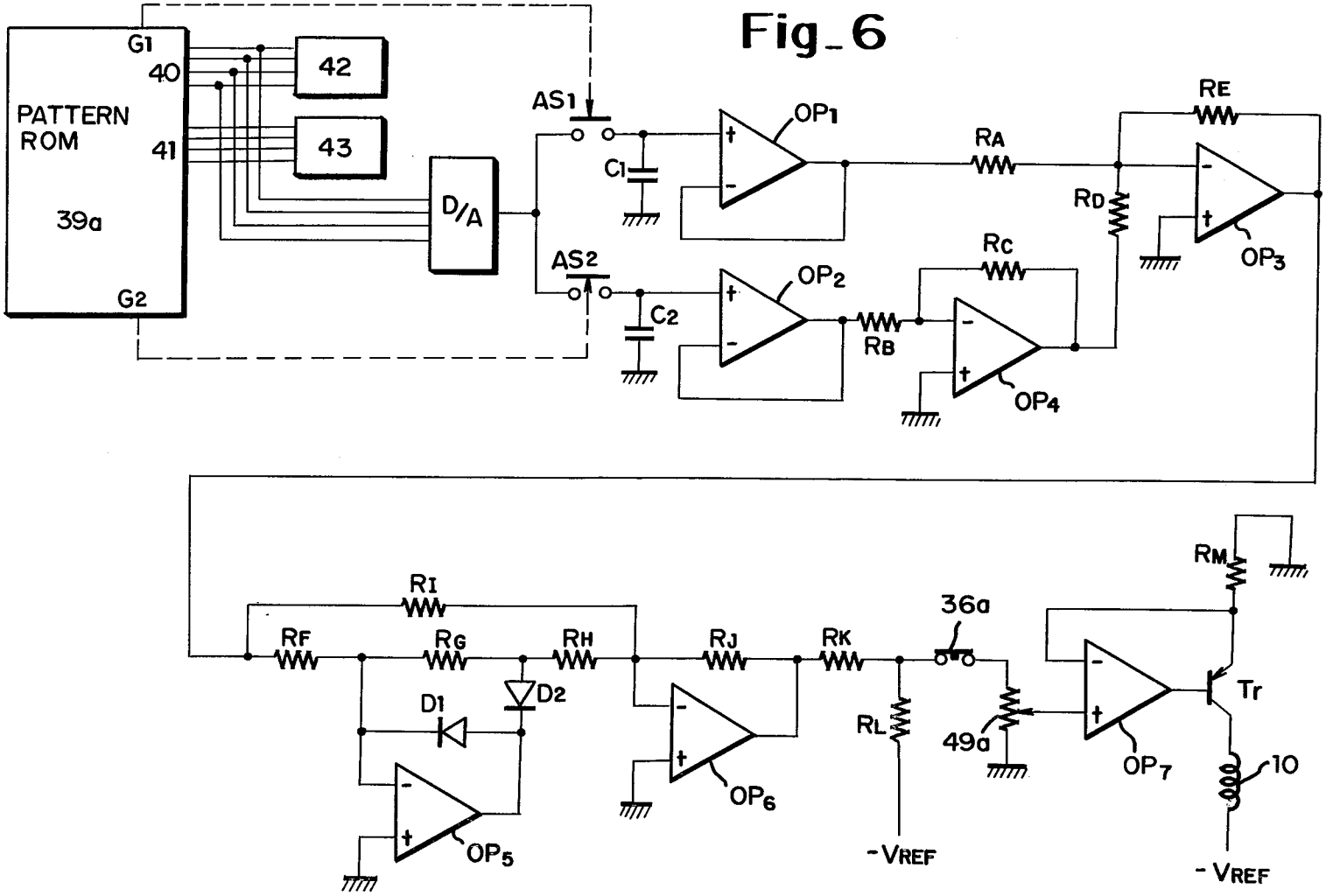
FIG. 6 depicts a third exemplary control circuit for the device of FIG. 1.

In the control circuit of FIG. 5, the thread-tension value is automatically varied, if necessary, from one constituent stitch of a stitch-pattern to the next, but this requiring that each addressable storage location of the pattern ROM 39 have extra bit-capacity for the tension-control code word which governs this action. FIG. 6 depicts a similar embodiment in which, however, no such additional bit-storage capacity is required for the pattern ROM.

The pattern ROM 39*a* of FIG. 6 transmits needle-bar position commands from its output 40 to the machine's needle-bar positioner unit 42, and feed commands from its outputs 41 to the machine's cloth feeder unit 43, as in the embodiment of FIG. 5. Pattern ROM 39*a* does not per se produce separate tension-control output bits. Instead, appropriate tension-control signals for each successive stitch of a stitch-pattern are derived from the mere stitch-control data produced by ROM 39*a*. In particular, the thread tension value to be established between each constituent needle penetration of a stitch-pattern and the next needle penetration is automatically ascertained by subtracting each needle-bar position command from the preceding needle-bar position command, the position commands being expressed as 5-bit binary code words whose numerical values correspond to different respective transversely displaced positions of the machine's needle bar, i.e., such that the binary-arithmetic difference of two successive 5-bit needle-bar position commands directly correspond to the physical distance between the two commanded needle-bar positions.

Each 5-bit needle-bar position command produced at outputs 40 of pattern memory 39*a* is applied to the input of a digital-to-analog converter D/A. The analog version of the needle-bar position command produced at the output of converter D/A is applied either to a holding capacitor $C_1$ or to a holding capacitor $C_2$, depending upon which of two respective analog switches $AS_1$, $AS_2$ is briefly closed. Pattern ROM 39*a* has two gating-signal outputs $G_1$ and $G_2$. When the address signal applied to the (non-illustrated) address-signal input of ROM 39*a* changes, ROM 39*a* produces an output pulse at gating-signal output $G_1$ just before the data for the newly addressed ROM storage location actually appear at ROM outputs 40, 41. The pulse produced at output $G_1$ renders analog switch $AS_1$ briefly transmissive, and the analog position-indicating signal present at the output of converter D/A is registered by holding capacitor C1. Just after the data in the newly addressed storage location appear at the outputs 40, 41 of ROM 39*a*, a brief pulse is produced at gating-signal output $G_2$, rendering analog switch $AS_2$ briefly conductive so that the analog version of the new needle-bar position command be registered by holding capacitor $C_2$.

The voltage held on capacitor $C_1$ is transmitted via an operational amplifier $OP_1$ to the input resistor $R_A$ of an operational amplifier $OP_3$ provided with a feedback resistor $R_E$. The voltage held on capacitor $C_2$ is transmitted via an operational amplifier $OP_2$, but additionally via an operational-amplifier inverter $R_B$, $OP_4$, $R_C$, to the input resistor $R_D$ of operational amplfier $OP_3$. Accordingly, the input signal received by the inverting input of operational amplifier $OP_3$ directly corresponds to the difference between the new needle-bar position command and the preceding needle-bar position command.

The output signal of $OP_3$ is applied to an absolute-value generator comprised of operational amplifiers $OP_5$, $OP_6$, diodes $D_1$, $D_2$, and resistors $R_F$, $R_G$, $R_H$, $R_I$, $R_J$. The absolute-value generator produces a signal whose magnitude depends upon the difference-signal produced by $OP_3$ but whose polarity is independent of the polarity of the difference-signal. The absolute-value version of the difference-signal is applied via a resistor $R_K$, a switch 36*a* and a potentiometer 49*a* to the non-inverting input of an operational amplifier $OP_7$. The junction between resistor $R_k$ and switch 36*a* is connected to a source of negative operating voltage $-V_{REF}$ via a resistor $R_L$. Operational amplifier $OP_7$ is connected with a transistor Tr and a resistor $R_M$ to form a constant-current source whose load is constituted by solenoid winding 10.

As each stitch of the pattern read out from ROM 39*a* is commanded, the energizing current flowing through solenoid winding 10 is automatically adjusted to a value corresponding to the distance between the two sucessive needle penetration locations involved.

FIG. 7 depicts an alternative electromechanical mechanism for thread-tension control. A reversible electric motor 53 drives a shaft 54 having a threaded section 54*a*. An internally threaded stop member 55 is threaded on threaded portion 54*a* and shifts in the direction axially of shaft 54 as the latter is rotated by motor 53 in one or the opposite direction. A helical compression spring 56 is confined axially intermediate stop member 55 and one of two tension-control disks 57. The biasing pressure of compression spring 56 is adjusted by adjusting the axial position of stop member 55 along the length of the threaded portion 54*a* of shaft 54. Compression spring 56 presses the tension-control disks 57 leftwards against a pressure-bearing member 58 provided with a pressure transducer 59, e.g., a strain gauge, operative for producing an electrical signal indicative of the force with which the tension-control disks 57 are being pressed together. Additionally, reversible electric motor 53 may be provided with a rotary transducer 100 operative for generating a signal indicating the angular position of output shaft 54 over a range of angular values equal to a multiple of 360°, i.e., for a range of angular positions spanning several rotations of output shaft 54.

Figure 8:
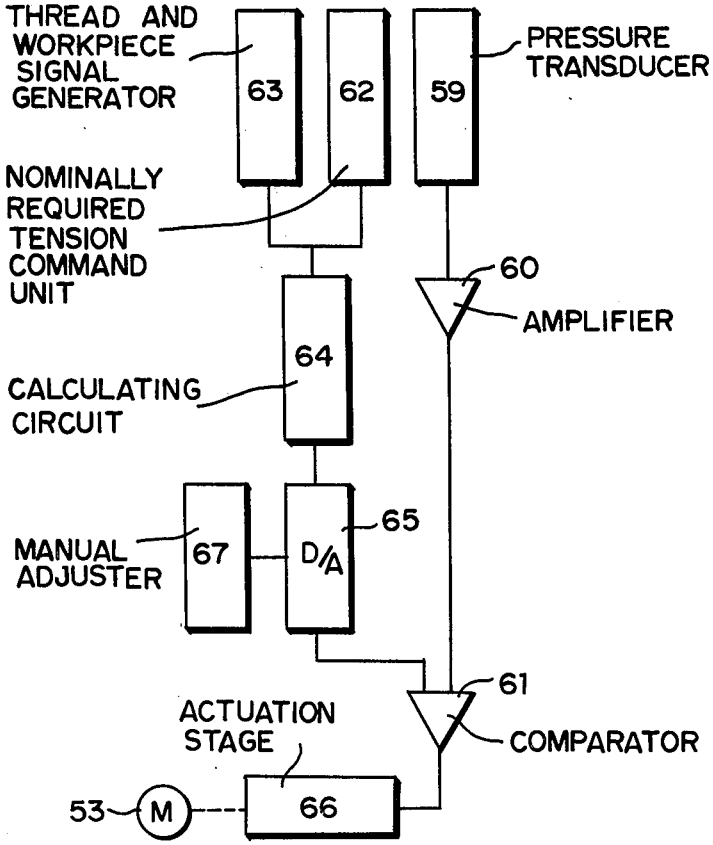
FIG. 8 is a schematic block diagram of a control circuit for the tension-varying device of FIG. 7.

FIG. 8 depicts an exemplary control circuit for controlling the reversible electric motor 53 of FIG. 6. In FIG. 8, motor 53 is energized by an actuation stage 66, which may for example be essentially comprised of a power amplifier. Actuation stage 66 receives at its input a signal depending on the difference, i.e., the error, as between the actual pressure with which the tension-control disks 57 are being pressed together, on the one hand, and, on the other hand, the pressure with which disks 57 are commanded to press against each other. This error signal is furnished by a comparator of subtractor 61. The right input of subtractor 61 receives a signal indicative of the pressure with which disks 57 are actually being pressed together. This signal is furnished by pressure transducer 59, through the intermediary of an amplifier 60 which will in general amplify the pressure-transducer output signal and, possibly also, have a non-linear transfer function compensatory for any non-linear pressure-versus-output-signal behavior on the part of pressure transducer 59. The left input of subtractor 61 receives a signal commanding the requisite value of pressure for disks 57. This command signal is in analog form and is produced at the output of a digital-to-analog converter 65, whose input receives a digital version of the same signal. Numeral 67 denotes a manually operated adjuster stage which can be operated when the user wishes to depart from the automatically selected thread-tension values. Manual adjuster stage 67 may, for example, essentially consist of an adjustable voltage divider serving to multiply by a manually adjusted factor the analog voltage produced by stage 65.

The digital version of the pressure command signal received by digital-to-analog converter 65 is furnished by a calculator and/or memory circuit 64. Calculator circuit 64 receives, from a stage 62, a signal indicative of a nominally required thread-tension value. The nominal-tension signal may be a respective constant signal for each of a plurality of selectable stitch-patterns, e.g., as in FIG. 3 where selection of one pattern produces a nominal tension command for the selected pattern (the merely nominal tension command being adjustable by means of user-operated potentiometer 18, in order to take into account factors such as cloth thickness, thread thickness and type). Alternatively, the nominal tension command signal produced by stage 62 of FIG. 9 may be derived from thread-tension control bits such as produced at outputs 44, 45 of pattern ROM 39 of FIG. 5. Or stage 62 may produce the nominal tension command signal in the manner of FIG. 6, i.e., by computing the physical distance between successive neelde-penetration locations of a stitch-pattern on the basis of the stitch-control data which implement the stitch-pattern.

Calculator circuit 64 furthermore receives, from a stage 63, data identifying those characteristics of the thread employed and of the material being sewn which have relevance for correct selection of a thread-tension value. As to the characteristics of the sewn fabric, the one of chief relevance is the thickness of the fabric, e.g., the thickness of several layers of sewn fabric. The generation of a clotch-thickness signal may be performed by a displacement transducer cooperating with the machine's cloth presser foot; when the presser foot is lowered into pressing engagement against the sewn fabric, the gap between the presser foot and the position it would occupy if no fabric at all were present is directly indicative of fabric thickness, and a displacement transducer for the presser foot can thus generate a signal directly indicative of cloth thickness. As to the characteristics of the thread employed, an important one is thread thickness, and a signal indicating thread thickness can be generated using an automatic thread-thickness gauge. However, equally important may be thread strength, not always to be simply equated with thread thickness, and also thread type, e.g., smooth such as to resist tensioning by tension disks 57 or rough such as to tend to be overly tensioned. If the thread-character signal is to be more than a simple thread-thickness signal, then use may, for example, be made of spools of thread provided on one axial end face with a standardized and machine-readable code number identifying a thread-character factor to be taken into account in the automatic selection of thread tension; this makes it unnecessary to use a separate thread thickness gauge, and furthermore makes it unnecessary for the operator to evaluate, subjectively or otherwise, the effect of a particular supply of thread upon the need for possible manual adjustment of automatically selected tension values.

The nominally-required-tension command signal, the character-of-thread signal, and the cloth-thickness signal are processed by calculator circuit 64 to yield at the output thereof an exactly correct tension command signal. The calculation of a correct tension command signal may be more or less simple. The cloth-thickness signal and the character-of-thread signal may, for example, be combined to form a corrective factor which is then applied to the nominally-required tension command signal from stage 62 to yield an exactly correct tension command signal. The combining of the cloth-thickness signal and character-of-thread signal to yield an appropriate corrective factor may be performed by actual computational circuitry, designed to derive the corrective factor in accordance with a preestablished, and empirically verified formula appropriate for a particular machine. Alternatively, instead of pure computation, circuit stage 64 might be mainly comprised of a corrective-factor memory, each of whose storage locations stores a respective corrective factor, with the value of the character-of-thread signal and the value of the cloth-thickness signal each serving to form part of the address of one of the storage locations of such corrective-factor memory; e.g., if the character-of-thread signal has a value within a particular one of, for example, ten different ranges of values, and if the cloth-thickness signal has a value within a particular one of, for example ten different ranges of cloth-thickness values, these two ranges in conjunction can directly constitute an address signal addressing a storage location which stores the corrective factor appropriate for that particular combination of values of the character-of-thread signal and the cloth-thickness signal. It will be appreciated that, among designers of tension-control systems, the thread-tension values appropriate for differing combinations of thread thickness and type and fabric thickness are readily ascertained. Actually, however, it is likewise within the skill of the art to apply empirical formulas interrelating character of thread, fabric thickness and interstitch distance, so that in general circuit stage 64 may, quite appropriately, be designed as an actual special-purpose calculator circuit, i.e., not merely be an addressable storage storing corrective factors such as just described.

In FIG. 9, subtractor 61 forms the difference between two signals, one indicating the commanded pressing force with which tension disks 57 are to be pressed together, the other being derived from pressure sensor 59 and indicating the force with which disks 57 are actually being pressed together, for negative-deedback control of disk-pressing force per se. However, instead of pressure sensor 59, use could be made of the angular-position transducer 100 of FIG. 6, to apply to the right input of subtractor 61 a signal indicative of the present angular position of output shaft 54, and thereby indicative of the present axially displaced position of stop member 55. Of course, in that event, the analog command signal applied to the left input of servo subtractor must be scaled in accordance with angular-position values of rotary transducer 100, i.e., instead of being scaled in accordance with disk-pressing force values per se.

In the embodiment of FIG. 9, the command signal applied to the left input of servo subtractor 61, indicative of the required value of disk pressing force or indicative of the required angular position of output shaft 54, is compared againt a feedback signal, the resultant error signal actuating adjuster motor 53. It will be appreciated, however, that the feedback branch from sensor 59 or from rotary transducer 100 could be eliminated, and the analog command signal produced at the output of converter 65 instead used to set the level of energization of the solenoid winding 10 of FIG. 1. Conversely, the command signal produced by the circuits of FIGS. 3, 5 and 6, used in those Figures for open-loop control current, could instead be applied to one input of a servo comparator, such as 61 in FIG. 9, the other input of the comparator receiving a feedback signal from, e.g., a pressure transducer such as 59 in FIG. 8.

It will be understood that each of the elements described above, or two or more together, may also find a useful application in other types of circuits and constructions differing from the types described above.

While the invention has been illustrated and described as embodied in automatic tension-control systems making use of particular tension-control mechanisms, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sewing machine of the type provided with pattern selector means operated by the user for implementing selected ones of a plurality of differently configured stitch-patterns, in combination, electromechanical thread-tension varying means operative for varying the tension of the thread fed to the sewing needle of the machine in response to a variable electrical tension command signal; and tension command signal generating means operative for furnishing to the electromechanical thread-tension varying means an electrical tension command signal, and including means for automatically selecting different values for the tension command signal, and thereby different values of thread tension produced by the thread-tension varying means, without the user of the machine needing to separately command said different values for the tension command signal, the means automatically selecting different values for the tension command signal being responsive to user operation of the pattern selector means, whereby the automatic selection of different values for the tension command signal is performed automatically as an incident to the user selecting different stitch-patterns.

2. In a sewing machine as defined in claim 1, furthermore including auxiliary user-operated selecting means operable by the user for altering the automatically selected values for the tension command signal when the user wishes to deviate from the automatically selected values.

3. In a sewing machine as defined in claim 2, the tension command signal generating means comprising a voltage divider comprised of at least two series-connected resistor stages, one resistor stage comprising a plurality of parallel-connected circuit branches each of which includes a resistor of different respective resistance value and a switch which closes in response to selection of a respective pattern by the user-operated pattern selector means, the other resistor stage comprising a potentiometer having an adjustable wiper manually adjustable by the user and constituting the auxiliary selecting means operated by the user when the user wishes to deviate from the automatically selected values for the tension command signal, the tension command signal being produced at the wiper of the potentiometer.

4. In a sewing machine as defined in claim 2, the sewing machine being provided with a user-operated presser-foot member moved by the user to a first setting to lift the cloth presser foot of the machine up out of engagement with sewn cloth and moved by the user to a second setting to lower the cloth presser foot of the machine down into engagement against sewn cloth, the means for automatically selecting different values for the tension command signal including means automatically changing the value of the tension command signal when the user-operated presser-foot member is moved to the first setting thereof.

5. In a sewing machine as defined in claim 3, the sewing machine being provided with a user-operated presser-foot member moved by the user to a first setting to lift the cloth presser foot of the machine up out of engagement with sewn cloth and moved by the user to a second setting to lower the cloth presser foot of the machine down into engagement against sewn cloth, said voltage divider furthermore including a third resistor stage, the means for automatically changing the value of the tension command signal furthermore including switch means operative when the presser-foot member is in its second setting for connecting the first and second resistor stages in series but operative when the presser-foot member is in its first setting for connecting the second and third resistor stages in series.

6. In a sewing machine as defined in claim 1, the electromechanical thread-tension varying means having a range of settings respectively producing differing amounts of thread tension and furthermore including a feedback transducer cooperating with the thread-tension varying means and generating a feedback signal indicating the present setting of the thread-tension varying means, and means automatically changing the setting of the thread-tension varying means in dependence upon the discrepancy between the tension command signal and the feedback signal.

7. In a sewing machine as defined in claim 6, the electromechanical thread-tension varying means including a pressure-applying structure operative for tensioning thread by applying pressure to the thread, the feedback transducer being a pressure transducer generating a signal indicating the amount of pressure applied by the pressure-applying structure.

8. In a sewing machine as defined in claim 6, the electromechanical thread-tension varying means including a rotary structure rotatable for varying the tension applied to thread, the feedback transducer being an angular position transducer generating a feedback signal indicating the angular position of the rotary structure.

9. In a sewing machine as defined in claim 1, the electromechanical thread-tension varying means comprising a pair of cooperating tension disks between which thread to be tension is guided, a solenoid comprising a plunger-type armature and a solenoid winding encircling the plunger-type armature, the magnitude of electrical current flowing through the solenoid winding determining the force with which the plunger-type armature is urged, the solenoid being provided with two confining portions between which the tension disks are confined, one confining portion being provided on the armature and the other being stationary.

10. In a sewing machine as defined in claim 1, the electromechanical thread-tension varying means comprising a pair of cooperating tension disks between which thread to be tensioned is guided, a compression spring located to press one of the tension disks against the other, and electrically controlled pressing means pressing the compression spring against said one of the tension disks with an adjustable pressing force serving to vary the precompression of the compression spring, the electrically controlled pressing means including a reversible electric motor, a threaded shaft driven by the motor, an internally threaded pressing member threaded on the threaded shaft and pressing the compression spring against said one of the tension disks, rotation of the threaded shaft resulting in displacement of the internally threaded pressing member along the length of the shaft and thereby resulting in adjustment of the precompression of the compression spring.

11. In a sewing machine provided with a user-operated presser-foot member moved by the user to a first setting to lift the cloth presser foot of the machine up out of engagement with sewn cloth and moved by the user to a second setting to lower the cloth presser foot of the machine down into engagement against sewn cloth, in combination, electromechanical thread-tension varying means operative for varying the tension of the thread fed to the sewing needle of the machine in response to a variable electrical tension command signal; and tension command signal generating means operative for furnishing to the electromechanical thread-tension varying means an electrical tension command signal, and including means for automatically selecting different values for the tension command signal, and thereby different values of thread tension produced by the thread-tension varying means, without the user of the machine needing to separately command said different values for the tension command signal, the means for automatically selecting different values for the tension command signal including means responsive to the setting of the user-operated presser-foot member.

12. In a sewing machine as defined in claim 11, the means responsive to the setting of the user-operated presser-foot member comprising means operative when the presser-foot member is moved by the user to the first setting thereof for automatically establishing a predetermined value for the tension command signal; and furthermore including auxiliary user-operated selecting means operable by the user for altering the tension command signal value automatically selected in response to the first setting of the presser-foot member, whereby if the machine is used for basting with the cloth presser foot in raised position thread tension is nevertheless maintained and is furthermore user-adjustable.

13. In a sewing machine of the type provided with a pattern memory consisting of addressable storage locations which store stitch-control data for at least one stitch-pattern, the pattern memory having stitch-control data outputs at which appear the stitch-control data contained in a memory storage location when that storage location is addressed, the storage locations furthermore storing tension-control data and the pattern memory additionally having tension-control data outputs at which appear the tension-control data contained in a memory storage location when that storage location is addressed, in combination, electromechanical thread-tension varying means operative for varying the tension of the thread fed to the sewing needle of the machine in response to a variable electrical tension command signal; and tension command signal generating means operative for furnishing to the electromechanical thread-tension varying means an electrical tension command signal, and including means for automatically selecting different values for the tension command signal, and thereby different values of thread tension produced by the thread-tension varying means, without the user of the machine needing to separately command said different values for the tension command signal, the means for automatically selecting different values for the tension command signal being at least in part constituted by the tension-control data outputs of the memory.

14. In a sewing machine as defined in claim 13, the means for automatically selecting different values for the tension command signal comprising means deriving the tension command signal from the data produced at the tension-control data outputs of the memory.

15. In a sewing machine as defined 14, furthermore including auxiliary user-operated selecting means operable by the user for altering the automatically selected values for the tension command signal when the user wishes to deviate from the automatically selected values.

16. In a sewing machine as defined in claim 15, the means deriving the tension command signal from the data produced at the tension-control data outputs of the memory comprising means for deriving an analog tension command signal, the auxiliary user-operated selecting means comprising a potentiometer receiving the analog tension command signal and having a user-adjusted wiper.

17. In a sewing machine of the type provided with a pattern memory consisting of addressable storage locations which store stitch-control data for at least one stitch-pattern, the pattern memory having stitch-control data outputs at which appear the stitch-control data contained in a memory storage location when that storage location is addressed, in combination, electromechanical thread-tension varying means operative for varying the tension of the thread fed to the sewing needle of the machine in response to a variable electrical tension command signal; and tension command signal generating means operative for furnishing to the electromechanical thread-tension varying means an electrical tension command signal, and including means for automatically selecting different values for the tension command signal, and thereby different values of thread tension produced by the thread-tension varying means, without the user of the machine needing to separately command said different values for the tension command signal, the means for automatically selecting different values for the tension command signal including means receiving the stitch-control data and deriving the tension command signal therefrom.

18. In a sewing machine as defined in claim 17, the means deriving the tension command signal from the stitch-control data comprising calculating circuit means operative for calculating appropriate values for the tension command signal dependent upon the stitch-control data.

19. In a sewing machine as defined in claim 18, the calculating circuit means comprising means operative for calculating from the stitch-control data distance-dependent values dependent upon the physical distances from one constituent needle-penetration location of a stitch-pattern to the next and producing the tension command signal in dependence upon the distance-dependent values.

20. In a sewing machine of the type provided with pattern selector means operated by the user for selecting differently configured stitch-patterns, in combination, electromechanical thread-tension varying means operative for varying the tension of the thread fed to the sewing needle of the machine in response to a variable electrical tension command signal; and tension command signal generating means operative for furnishing to the electromechanical thread-tension varying means an electrical tension command signal, and including means for automatically selecting different values for the tension command signal, and thereby different values of thread tension produced by the thread-tension varying means, without the user of the machine needing to separately command said different values for the tension command signal, the means for automatically selecting different values for the tension command signal comprising means furnishing a nominally-required-tension signal in dependence upon the selected pattern and indicating the thread tension nominally required, means furnishing cloth and thread signals dependent upon the thickness of the cloth to be sewn and dependent upon the thread to be employed, and means deriving the tension command signal from the nominally-required-tension signal and the cloth and thread signals.

* * * * *